US005781220A

United States Patent [19]

Nishizono et al.

[11] Patent Number: 5,781,220

[45] Date of Patent: Jul. 14, 1998

[54] THERMAL HEAD

[75] Inventors: Atsuo Nishizono; Hideo Noguchi; Keijiro Minami; Shinji Hirata; Hitoshi Takao; Koji Kato; Tetsuji Hyodo; Kazuyuki Itaki, all of Aira-gun, Japan

[73] Assignee: Kyocera Corporation, Kyoto, Japan

[21] Appl. No.: 752,554

[22] Filed: Nov. 20, 1996

Related U.S. Application Data

[63] Continuation of Ser. No. 471,049, Jun. 6, 1995, abandoned.

[30] Foreign Application Priority Data

Jul. 29, 1994 [JP] Japan ..... 6-179110
Sep. 22, 1994 [JP] Japan ..... 6-227620

[51] Int. Cl.[6] ..... B41J 2/345

[52] U.S. Cl. ..... 347/208; 347/209

[58] Field of Search ..... 347/208, 210, 347/209, 201

[56] References Cited

U.S. PATENT DOCUMENTS 5,335,002 8/1994 Nagahata et al. ..... 347/209

FOREIGN PATENT DOCUMENTS 59-27539 2/1984 Japan .
234251 3/1990 Japan .
6-47943 2/1994 Japan ..... 347/209

*Primary Examiner*—Huan H. Tran
*Attorney, Agent, or Firm*—Loeb & Loeb LLP

[57] ABSTRACT

The invention relates to a thermal head which comprises: a plurality of heating elements arranged at regular intervals on the top surface of an electrically insulating substrate; a common electrode connected to one ends of the respective heating elements; a plurality of discrete lead wires connected to the other ends of the respective heating elements and led out in directions at predetermined angles with respect to the direction of arrangement of the heating elements; and driving IC including a plurality of connecting pads arranged nearly parallel with the direction of arrangement of the heating elements and with intervals smaller than the intervals of arrangement of the heating elements, the connecting pads connected to lead-out sections of the discrete lead wires, wherein the connecting pads of the driving IC are arranged with intervals between the neighboring connecting pads which vary depending on the sine values of angles between the direction of arrangement of the heating elements and the lead-out directions of the respective discrete lead wires.

8 Claims, 7 Drawing Sheets

$\sin\theta 1 < \sin\theta 2 \longrightarrow P2 > P3$

THERMAL HEAD

This is a continuation of application Ser. No. 08/471,049 filed on Jun. 6, 1995, now abandoned.

BACKGROUND OF THE INVENTION

1. Field of the Invention

The present invention relates to an improved thermal head which is incorporated as a printing mechanism in word processors, facsimile machines, etc.

2. Description of the Related Art

As shown in FIG. 9A, a thermal head of the prior art which is incorporated as a printing mechanism in word processors, etc. includes an electrically insulating substrate 11 which is made of alumina ceramic or the like, on the top surface of which are mounted a plurality of heating elements 12 made of tantalum nitride or the like which are arranged in a straight line at regular intervals P1, a common electrode 13 made of a metallic material such as copper which is commonly connected to one end of each of the heating elements 12, a plurality of discrete lead wires 14 made of a metallic material such as aluminum each of which is separately connected to the other end of each of the heating elements 12, and a driving circuit (integrated circuit) 15 including a plurality of connecting pads **15*a* arranged almost in parallel with the direction of arrangement of the heating elements 12, which connecting pads 15*a* are connected to the discrete lead wires 14** with an electrically conductive bonding agent such as solder.

The thermal head constructed in this way may function by applying a predetermined power between the common electrode 13 and the discrete lead wires 14 on the basis of printing signals while the driving IC 15 is driven, to selectively generate Joule heat in the heating elements 12, and then conducting the generated heat to a recording medium such as heat-sensitive paper for production of a predetermined printed image on the recording medium.

To make the driving ICs 15 more compact in such a thermal head, a regular interval P2 of arrangement of the connecting pads **15*a* is set to be smaller than an interval P1 of arrangement of the heating elements 12. The discrete lead wires 14 establish the connections between the heating elements 12 and the connecting pads 15*a*** in the shortest distances.

In addition, the plurality of heating elements 12 are arranged with high density equal to or more than 8 dots/mm. The heating elements 12 and the discrete lead wires 14 are each formed and adhered on the top surface of the electrically insulating substrate 11 usually by employing a thin-film formation technique such as sputtering, and photolithography technique.

However, all the connecting pads **15*a* are arranged at intervals P2 smaller than the arrangement intervals P1 of the heating elements 12, and the discrete lead wires 14 connected to the connecting pads 15*a* establish the connection between the heating elements 12 and the connecting pads 15*a* in the shortest distances. Therefore, the distances H between the discrete lead wires 14 neighboring each other which are placed in the vicinity of the driving ICs 15, are different depending on the sine value (=sinθ) of an angle θ contained by the arrangement direction of the heating elements 12, namely the connecting pads 15*a*, and the patterning direction of the discrete lead wires 14**, as shown in FIG. 9B.

Hence, the distances are extremely small in the discrete lead wires 14 having the small sine values, specifically in the vicinity of the driving IC 15. As a consequence this makes it difficult to exactly pattern the discrete lead wires 14 by photolithography, etc. In addition, short circuits are easily caused between the discrete wires 14 neighboring each other or breaking of the discrete wires is frequently caused due to their fineness.

SUMMARY OF THE INVENTION

In order to overcome the above-mentioned problems, it is an object of the invention to provide a thermal head which allows readily patterning of all the discrete lead wires even in the case where a compact driving IC is mounted.

It is another object of the invention to provide a highly reliable thermal head which allows durable bonding of compact driving IC to any electrically insulating substrate.

The invention provides a thermal head comprising:

a plurality of heating elements arranged at regular intervals on the top surface of an electrically insulating substrate;

a common electrode connected to one ends of the respective heating elements;

a plurality of discrete lead wires connected to the other ends of the respective heating element and led out in a direction forming a predetermined angle with the direction of arrangement of the heating elements; and a driving integrated circuit including a plurality of connecting pads arranged nearly parallel with the direction of arrangement of the heating elements and at intervals smaller than the intervals of arrangement of the heating elements, the plurality of the connecting pads connected to lead-out sections of the discrete lead wires, wherein said connecting pads of the driving integrated circuit are arranged with intervals between the neighboring connecting pads which vary depending on the sine values of the angles between the direction of arrangement of the heating elements and the lead-out directions of the respective discrete lead wires.

Also, the invention provides a thermal head comprising.

an electrically insulating substrate;

a plurality of heating elements arranged at regular intervals on the top surface of the electrically insulating substrate;

a common electrode connected to one ends of the respective heating elements;

a plurality of discrete lead wires connected to the other ends of the respective heating elements and led out in directions at predetermined angles with respect to the direction of arrangement of the heating elements; and a driving integrated circuit including a plurality of connecting pads arranged nearly parallel with the direction of arrangement of the heating elements and at intervals smaller than the intervals of arrangement of the heating elements, the plurality of the connecting pads being connected to lead-out sections of the discrete lead wires, wherein connection electrodes on the substrate side which are to be connected to the connecting pads of the driving integrated circuit are arranged with distances between the neighboring connection electrodes which vary depending on the sine values of the angles between the direction of arrangement of the heating elements and the lead-out directions of the discrete lead wires.

Also, the invention provides a thermal head comprising:

a plurality of heating elements arranged at regular intervals on the top surface of an electrically insulating substrate;

a common electrode connected to one ends of the respective heating elements;

a plurality of discrete lead wires connected to the other ends of the respective heating elements and led out along arcs with predetermined curvatures; and a driving integrated circuit including a plurality of connecting pads arranged nearly parallel with the direction of arrangement of the heating elements and at intervals smaller than the intervals of arrangement of the heating elements, the plurality of the connecting pads being connected to lead-out sections of the discrete lead wires, wherein the connecting pads of the driving integrated circuit are arranged with intervals between the neighboring connecting pads which vary depending on the curvatures of the lead-out sections of the discrete lead wires.

Also, the invention provides a thermal head comprising:

an electrically insulating substrate;

a plurality of heating elements arranged at regular intervals on the top surface of the electrically insulating substrate;

a common electrode connected to one ends of the respective heating elements;

a plurality of discrete lead wires connected to the other ends of the heating elements and led out along arcs with predetermined curvatures; and a driving integrated circuit including a plurality of connecting pads arranged nearly parallel with the direction of arrangement of the heating elements and with intervals smaller than the intervals of arrangement of the heating elements, the plurality of connecting pads being connected to lead-out sections of the discrete lead wires, wherein connection electrodes on the substrate side which are to be connected to the connecting pads of the driving integrated circuit are arranged with distances between the neighboring connection electrodes which vary depending on the curvatures of the lead-out sections of the discrete lead wires.

According to the invention, the distances between the neighboring discrete lead wires may be extended even near the driving integrated circuit, and further the respective discrete lead wires may be readily patterned by photolithography technique, etc. This design of arrangement serves to effectively prevent short circuits between the neighboring discrete lead wires and breaking of discrete lead wires, etc.

Also, preferably the driving integrated circuit is designed in such a manner that more connecting pads are present in the end sections than in the central section of the driving integrated circuit, and further the intervals between the neighboring connecting pads are set to be shorter at the central section than at the end sections.

Further, preferably the connecting pads of the driving integrated circuit are designed in such a manner that the areas of the connecting pads are greater in the end sections than in the central section of the driving integrated circuit, and further the intervals between the neighboring connecting pads are set to be shorter at the central section than at the end sections.

According to the invention, the bonding strength of the driving integrated circuit to the electrically insulating substrate is particularly increased in both end sections of the driving integrated circuit. Accordingly, even in the case where great thermal stress is exerted on both end sections of the driving integrated circuit during high-speed printing etc., the bonding section between the driving integrated circuit and the electrically insulating substrate is effectively prevented from being broken due to the thermal stress. Accordingly, the thermal head may work in good condition over a long period of time.

DESCRIPTION OF THE EMBODIMENTS

Embodiments of the invention will be more explicit from the following detailed description taken with reference to the attached drawings wherein.

[First embodiment]

Figure 1A:
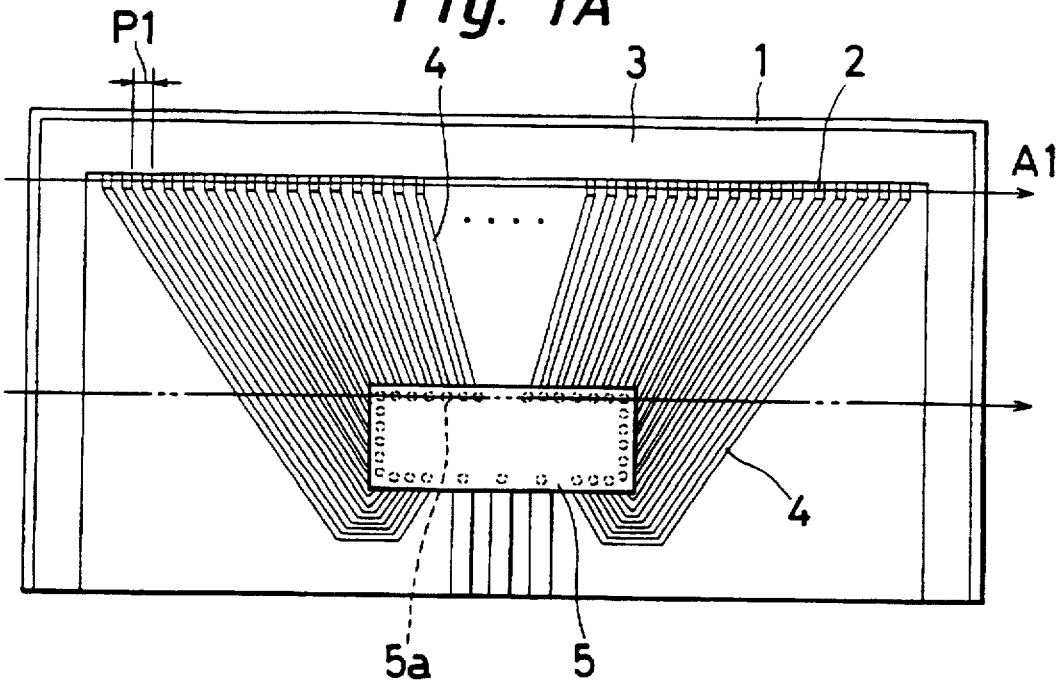
FIG. 1A is a plan view of an embodiment of the thermal head of the invention.
Figure 1B:
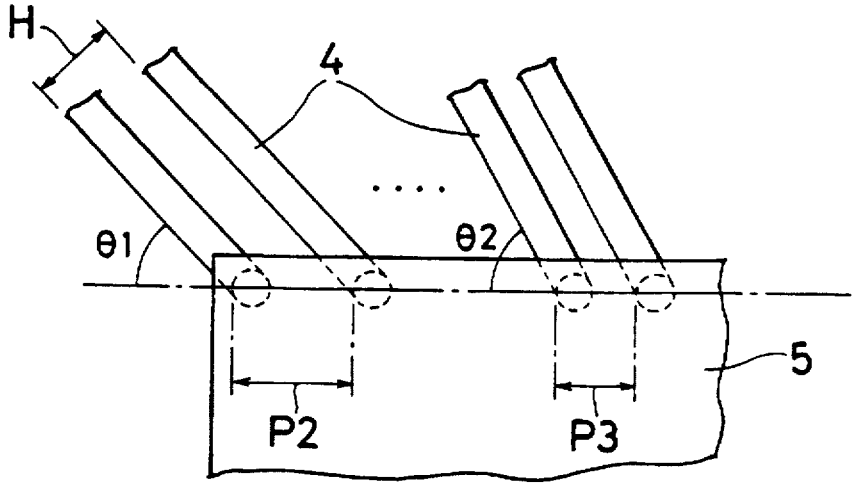
FIG. 1B is a partially enlarged view of FIG. 1A.

FIG. 1A is a plan view of an embodiment of the thermal head of the invention, and FIG. 1B is a partially enlarged view of FIG. 1A. In the drawings, reference numeral 1 indicates an electrically insulating substrate, reference numeral 2 indicates heating elements, reference numeral 3 indicates a common electrode, reference numeral 4 indicates discrete lead wires, reference numeral 5 indicates driving IC, and reference numeral **5*a*** indicates connecting pads.

The electrically insulating substrate 1 is composed of an electrically insulating material such as aluminum ceramic, and is prepared by mixing the powder of a ceramic material such as alumina, silica or magnesia with an appropriate organic solvent or dispersing agent added thereto and making a slush which is then subjected to the well-known doctor blade to prepare ceramic green sheets, and punching the ceramic green sheets to obtain a predetermined shape while sintering at a high temperature (about 1600° C.).

A heat accumulating layer composed of glass or the like (not shown) is bonded to the top surface of the electrically insulating substrate 1, and this heat accumulating layer has the function of maintaining excellent heat response properties of the thermal head by accumulating and diffusing heat generated by the heating element 2 described later.

In order to compose the heat accumulating layer composed of glass, for example, glass paste prepared by mixing powder glass with an appropriate organic solvent or dispersing agent added thereto is applied to the top surface of the electrically insulating substrate 1 to a predetermined thickness by well-known screen printing etc., and is then baked at a high temperature to provide a strap coat on the electrically insulating substrate 1.

In addition, to the top surface of the heat accumulating layer there are bonded a plurality of heating elements 2 arranged linearly at regular intervals P1, a common electrode 3 connected to one ends of the respective heating elements 2, and a plurality of discrete lead wires 4 connected to the other ends of the respective heating elements 2.

Since the heating elements 2 are made of tantalum nitride, titanium nitride or the like and thus have a predetermined electric resistance, so when a predetermined level of power is applied thereto via the common electrode 3 and the discrete lead wires 4, the temperature of the heating elements 2 increases due to generation of Joule heat up to a temperature necessary to produce a printed image, for example, 200°–350° C.

Further, the common electrode 3 and the discrete lead wires 4 which are connected to the heating elements 2 are made of a metal material such as aluminum, silver, copper or the like and have the function of applying a predetermined power to the heating elements 2 which is necessary to generate Joule heat in the heating elements 2.

The common electrode 3 and the discrete lead wires 4 are formed by any of the well-known thin-film forming techniques such as sputtering method and photolithography technique, while connected to both sides of the heating elements 2 by bonding.

Also, each of the discrete lead wires 4 is led out at a predetermined angle θ with respect to a direction A1 of arrangement of the heating elements 2, and more specifically, in the direction of the associated connecting pads 5*a* provided on the driving IC 5, and is connected electrically to connecting pad 5*a* on the driving IC 5 at its lead-out sections.

A plurality of connecting pads 5*a* on the driving IC 5 are arranged nearly parallel with the direction A1 of arrangement of the heating elements 2, at smaller intervals P2 through Pn than the arrangement interval P1 of the heating elements 2, and the driving IC 5 is electrically and mechanically connected to the discrete lead wires 4 by bringing the respective connecting pads 5*a* into contact with connection electrodes which are provided at the ends of the respective lead wires 4 via an electrically conductive bonding agent such as solder.

The driving IC 5 is rectangular and has a function of generating Joule heat in the heating elements 2 selectively based on printing signals, and more specifically, a function of controlling the on/off state of the power to be applied to the heating elements 2 via the common electrode 3 and the discrete lead wires 4.

Some of the connecting pads 5*a* are provided along one side of the driving IC 5 facing the heating elements 2, in such a manner that the intervals P2 through Pn between the neighboring connecting pads 5*a* vary depending on the sine values ($\sin\theta_1$ through $\sin\theta_{n-1}$) of the angles $\theta_1$ through $\theta_{n-1}$ which are formed between the direction A1 of arrangement of the heating elements 2 and the lead-out directions of the discrete lead wires 4, and more specifically, in such a manner that smaller sine values result in larger intervals P. For example, in the case where $\sin\theta_2=0.8$, the distance H between the neighboring discrete lead wires 4 is set to 56 μm, while the interval P3 between the neighboring connecting pads 5*a* is set to 70 μm. Also, in the case where $\sin\theta_1=0.73$, the distance H between the neighboring discrete lead wires 4 is set to 56 μm, while the interval P2 between the neighboring connecting pads 5*a* to 77 μm.

Thus varying the intervals P between the neighboring connecting pads 5*a* depending on the sine values of the angles between the direction of arrangement of the heating elements 2 and the lead-out direction of each discrete lead wires 4 makes it possible to make the distance H between the neighboring discrete lead wires 4 longer even near the driving IC 5. As a result, when the respective discrete lead wires are patterned by photolithography or the like, short circuits between the neighboring discrete lead wires 4 and breaking of the discrete lead wires 4, etc. are effectively prevented, and accordingly any desired wiring pattern may be formed with ease.

Connection electrodes at the side of the substrate 1 which are connected to the connecting pads 5*a* of the driving IC 5 are also similarly arranged with distances between the neighboring connecting electrodes that are varied depending on the sine values of the angles between the direction of arrangement of the heating elements 2 and the lead-out directions of the discrete lead wires 4.

In this connection, among the plurality of connecting pads 5*a*, some are arranged along the other side opposite to the one side of the driving IC 5 at an interval of, for example, 160 μm, whereas the others are arranged along sides orthogonal to the one side and the other side, with a space of, for example, 100 μm. These connecting pads 5*a* are also connected to the discrete lead wires 4 which are led out through the other ends of the heating elements 2, via a electrically conductive bonding agent such as solder.

Provision of the connecting pads 5*a* along the other side as well as the one side of the driving IC 5 allows more effective utilization of the entire top surface of the electrically insulating substrate 1. Accordingly, the connecting pads 5*a* are preferably provided also along the other side of the driving IC 5 as well.

Here, the connection between the driving IC 5 and the discrete lead wires 4 is established by the well-known face-down bonding method or the like.

Thus, the thermal head of the invention allows to apply a predetermined degree of power based on the printing signals between the common electrode 3 and the discrete lead wires 4, to selectively generate Joule heat in the heating elements 2 when the driving IC 5 is driven, and then to conduct the generated heat to a recording medium such as heat-sensitive paper for production of a printed image on the recording medium.

[Second embodiment]

Another embodiment of the invention will now be explained.

Figure 2:
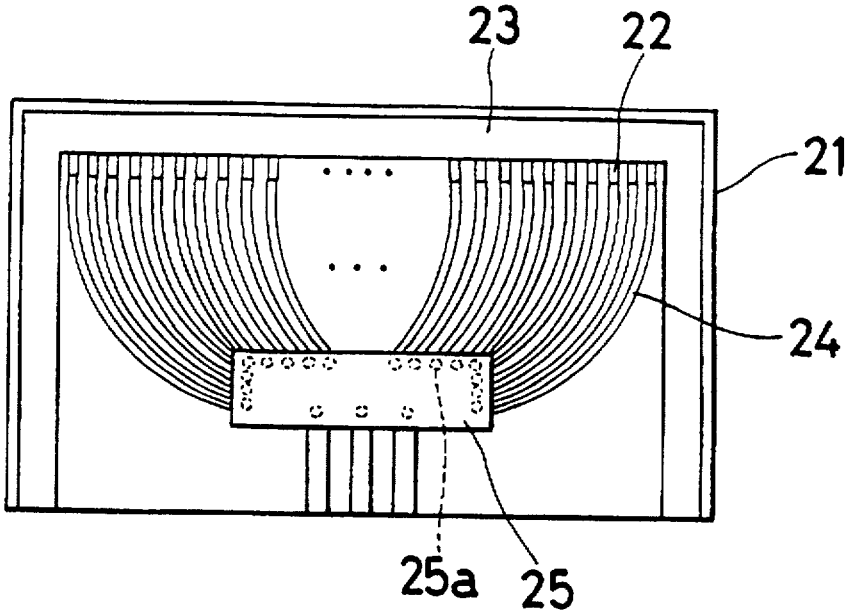
FIG. 2 is a plan view of another embodiment of the invention.

FIG. 2 is a plan view illustrative of another embodiment of the thermal head of the invention. In the drawing, reference numeral 21 indicates an electrically insulating substrate, reference numeral 22 indicates heating elements, reference numeral 23 indicates a common electrode, reference numeral 24 indicates discrete lead wires, reference numeral 25 indicates a driving IC, and reference numeral 25*a* indicates connecting pads of the driving IC 25.

This embodiment differs from the foregoing embodiment in that 1) the discrete lead wires 24 are led out along arcs which project outward with predetermined curvatures; and 2) the connecting pads 25*a* of the driving IC 25 are placed in such a manner that intervals between the neighboring connecting pads 25*a* are varied depending on the curvatures of the lead-out sections of the discrete lead wires 24, and more specifically, in such a manner that smaller curvatures of the-lead-out sections of the corresponding discrete lead wires 24 result in larger intervals between the neighboring connecting pads 25*a*.

For example, in the case where the radii r of curvatures of the lead-out sections of the discrete lead wires 24 connected to the connecting pads 25*a* are 10 mm, the distances between the neighboring discrete lead wires 24 is set to 15 μm, and the intervals between the neighboring connecting pads 25*a* are set to 70 μm. Also, in the case where the radii r of curvatures of the lead-out sections of the discrete lead wires 24 are 9.5 mm, the distances between the neighboring discrete lead wires 24 are set to 15 μm, and the intervals between the neighboring connecting pads 25*a* are set to 77 μm.

Even in the thermal head constructed in this way, the distances H between the neighboring discrete lead wires 24 may be made longer even near the driving IC 25, and further the respective discrete lead wires 24 may be readily patterned by photolithography, etc. This design serves to effectively prevent short circuits between the neighboring discrete lead wires 24 and breaking of the discrete lead wires 24, etc.

Figure 3:
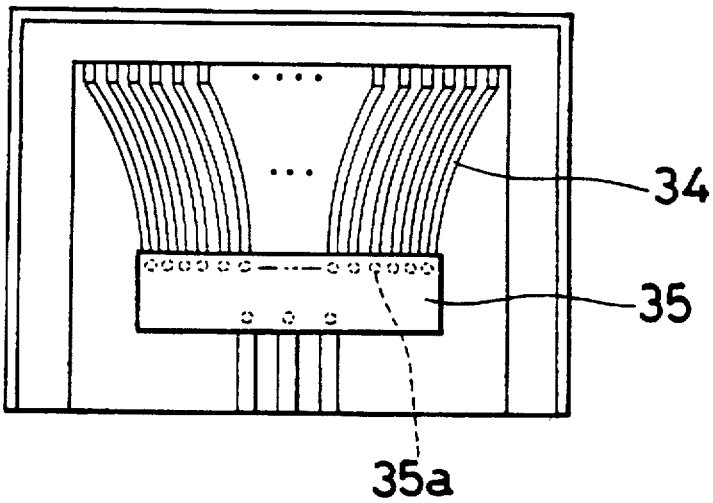
FIG. 3 is a plan view of an additional embodiment of the invention.

It is to be understood that the invention is not limited to the above-described embodiment, and may be modified and improved in a variety of ways without departing from the spirit of the invention. For example, although the discrete lead wires 24 according to the embodiment shown in FIG. 2 are led out along arcs projecting outward, the discrete lead wires 34 may be led out along arcs projecting inward instead, as shown in FIG. 3, and the intervals between the neighboring connecting pads 35*a* of the driving IC 35 may be varied depending on the curvatures of the lead-out sections of the lead wires 34, with the same effects as the above-described embodiment.

In addition, although the above-described embodiment is constructed with angles between the direction of arrangement of the heating elements and the lead-out directions of the discrete lead wires which are varied for every discrete lead wire, the angles which the direction of arrangement of the heating elements forms with the lead-out directions of the respective lead wires may be varied per group of plural of discrete lead wires instead, with the same effects as the above-described embodiment.

[Third embodiment]

An additional embodiment of the invention will now be explained.

Figure 4:
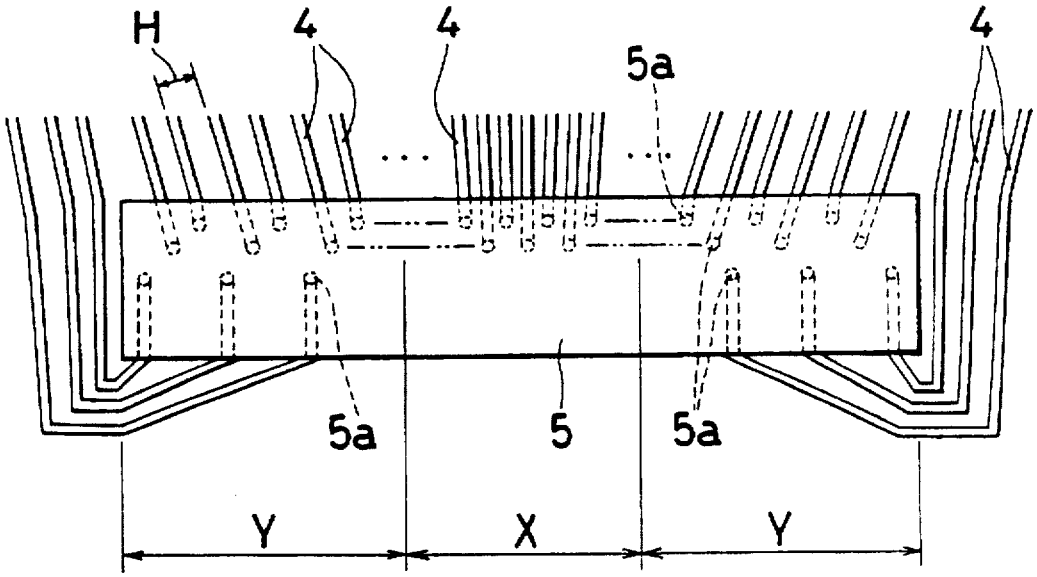
FIG. 4 is a partially enlarged view of an additional embodiment of the invention.

FIG. 4 is a partially enlarged view illustrative of an additional embodiment of the invention. In this embodiment, all the connecting pads 5*a* of the driving IC 5 have the same areas, and, as shown in FIG. 1, are arranged nearly parallel with the direction A1 of arrangement of the heating elements 2, with smaller intervals than the arrangement interval P1 of the heating elements 2. The respective connecting pads 5*a* are bonded to the corresponding discrete lead wires 4 by soldering to establish the electrical and mechanical connection between the driving IC 5 and the discrete lead wires 4.

The connecting pads 5*a* have a two-row arrangement in the central section X of the driving IC 5 and a three-row arrangement in the two end sections Y. As is apparent from comparison of all the connecting pads 5*a* present in the central section X with that in the end sections Y which are present in the two rows closest to the side of the heating elements 2, the intervals between the neighboring connecting pads 5*a* are varied. The intervals between the connecting pads 5*a* are set separately depending on the sine values (sin θ) of the angles θ between the direction A1 of arrangement of the heating elements 2 and the lead-out directions of the discrete lead wires 4. Specifically, the sine values are set smaller at the two end sections Y of the driving IC 5 and larger at the central section X so that the intervals between the neighboring connecting pads 5*a* are greater at the two end sections Y of the driving IC 5 and shorter at the center section X. As an example, the intervals at the central section X of the driving IC 5 are set to approximately 70 μm, while the intervals at the two end sections Y are approximately 140 μm.

With this setting of the intervals between the neighboring connecting pads 5*a* which are greater in the two end sections Y of the driving IC 5 and shorter in the central section X, the distances H between the neighboring discrete lead wires 4 may be made longer even near the two end sections Y of the driving IC 5, and thus the respective discrete lead wires 4 may be patterned reliably and readily by photolithography or the like. In addition, the number of connecting pads 5*a* which are present in a greater proportion in the two end sections Y of the driving IC 5 is larger than that in the central section X, as exemplified by a linear density of 14.3/mm in the central section X and a linear density of 17.9/mm in the two end sections Y.

This results in the increase of the number of bonding points between the driving IC 5 and the electrically insulating substrate 1 in the two end sections Y as compared with the central section X, and thus the bonding strength of the driving IC 5 to the electrically insulating substrate 1 is particularly increased in the two end sections Y of the driving IC 5. Accordingly, even in the case where the temperature of the thermal head is increased to a relatively high temperature by high-speed printing etc. and great thermal stress is exerted on the two end sections Y of the driving IC 5, the bonding section between the driving IC 5 and the electrically insulating substrate 1 is effectively prevented from being broken due to the thermal stress, and thus the thermal head may work satisfactorily over a long period of time.

Here, the connection between the driving IC 5 and the discrete lead wires 4 is established by the well-known face-down bonding method, etc.

The thermal head according to the invention constructed in this way allows application of predetermined levels of power between the common electrode 3 and the discrete lead wires 4 when the driving IC 5 is driven, to generate Joule heat in the heating elements 2 selectively based on printing signals, and conduction of the generated heat to a recording medium such as heat-sensitive paper to produce a predetermined printed image on the recording medium.

The present embodiment is illustrative of a case where the connecting pads 5*a* have a plural-row arrangement at the intervals of the connecting pads 5*a* which increase from the center section of the driving IC 5 to the end sections, and the connecting pads 5*a* may have different shapes on a row-by-row basis while keeping the same area. For example, in the case where the connecting pads are designed to be rectangular, the connecting pads 5*a* in the row nearest to the side ends of the driving IC 5 are formed with a width to length ratio (the ratio of the width to the length of the driving IC) of 4:1, while the ratio is 3:1 for the pads in the second row, 2:1 for the pads in the third row and 1:1 (= square) in the fourth row, respectively. With this arrangement, since the intervals between the connecting pads may be increased toward the side ends of the driving IC 5, the wiring density of the discrete lead wires may be increased immediately under the driving IC.

[Fourth embodiment]

Figure 5:
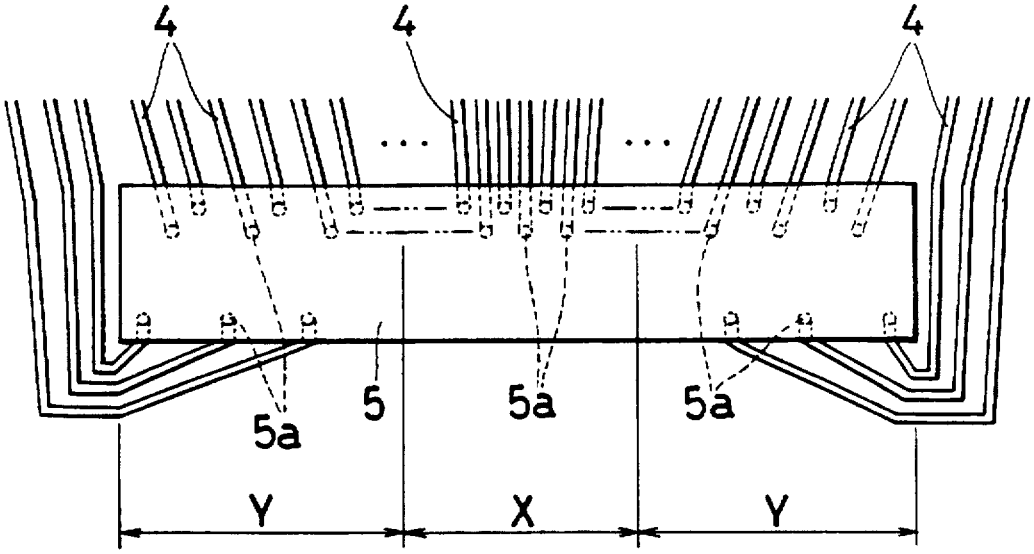
FIG. 5 is a partially enlarged view of an additional embodiment of the invention.

FIG. 5 is a partially enlarged view illustrative of a further embodiment of the invention. The thermal head shown in FIG. 5 is different from one as shown in FIG. 4 in that the connecting pads 5a placed in the two end sections Y of the driving IC 5 are arranged in three rows, and the pads 5a in the two of the rows are arranged in a staggered pattern along one side of the driving IC 5 which faces the heating elements 2, while the pads 5a in the remaining one row are arranged along the side opposite to the one side.

[Fifth embodiment]

Figure 6:
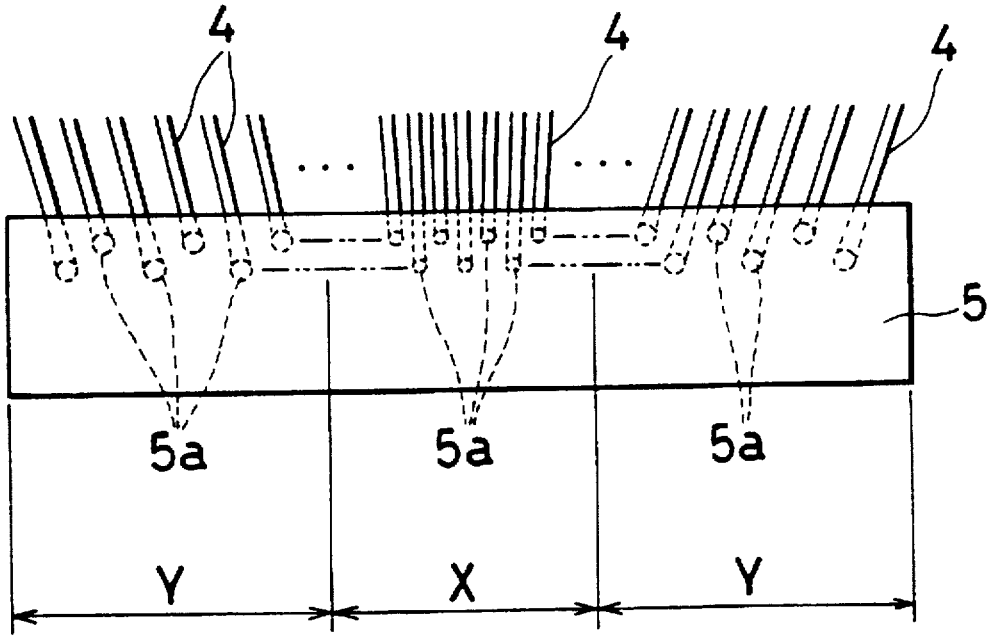
FIG. 6 is a partially enlarged view of an additional embodiment of the invention.

FIG. 6 is a partially enlarged view illustrative of a still further embodiment of the invention. The thermal head as shown in the FIG. 6 is different from the one as shown in FIG. 4 in that the connecting pads 5a placed in the two end sections Y of the driving IC 5 have larger areas than the connecting pads 5a placed in the center section X, and in that the respective connecting pads 5a are bonded to the discrete lead wires via an electrically conductive bonding agent (for example, solder) of an amount which depends on the respective areas of the pads 5a. For example, the connecting pads (diameter: $\phi$84 mm) placed in the two end sections Y each have an area of $5.5\times10^{-3}mm^2$, and the connecting pads 5a (diameter: $\phi$70 mm) placed in the central section X each have an area of $3.8\times10^{-3}mm^2$, and therefore the amount of the solder used for bonding between the connecting pads 5a in the two end sections Y and the discrete lead wires 4 is $1.6\times10^{-4}mm^3$, and that used for bonding between the connecting pads 5a in the center section X and the discrete lead wires 4 is $9.0\times10^{31\ 5}mm^3$.

Even in these thermal heads as shown in FIG. 5 and FIG. 6, since the driving IC 5 is bonded to the electrically insulating substrate 1 strongly at its two end sections Y in the same manner as the one shown in FIG. 4, even in the case where great thermal stress is exerted on the two end sections Y of the driving IC 5 due to high-speed printing etc., the bonding section between the driving IC 5 and the electrically insulating substrate 1 is effectively prevented from being broken due to thermal stress. Accordingly, the thermal heads may work satisfactorily over a long period of time.

[Sixth embodiment]

Figure 7:
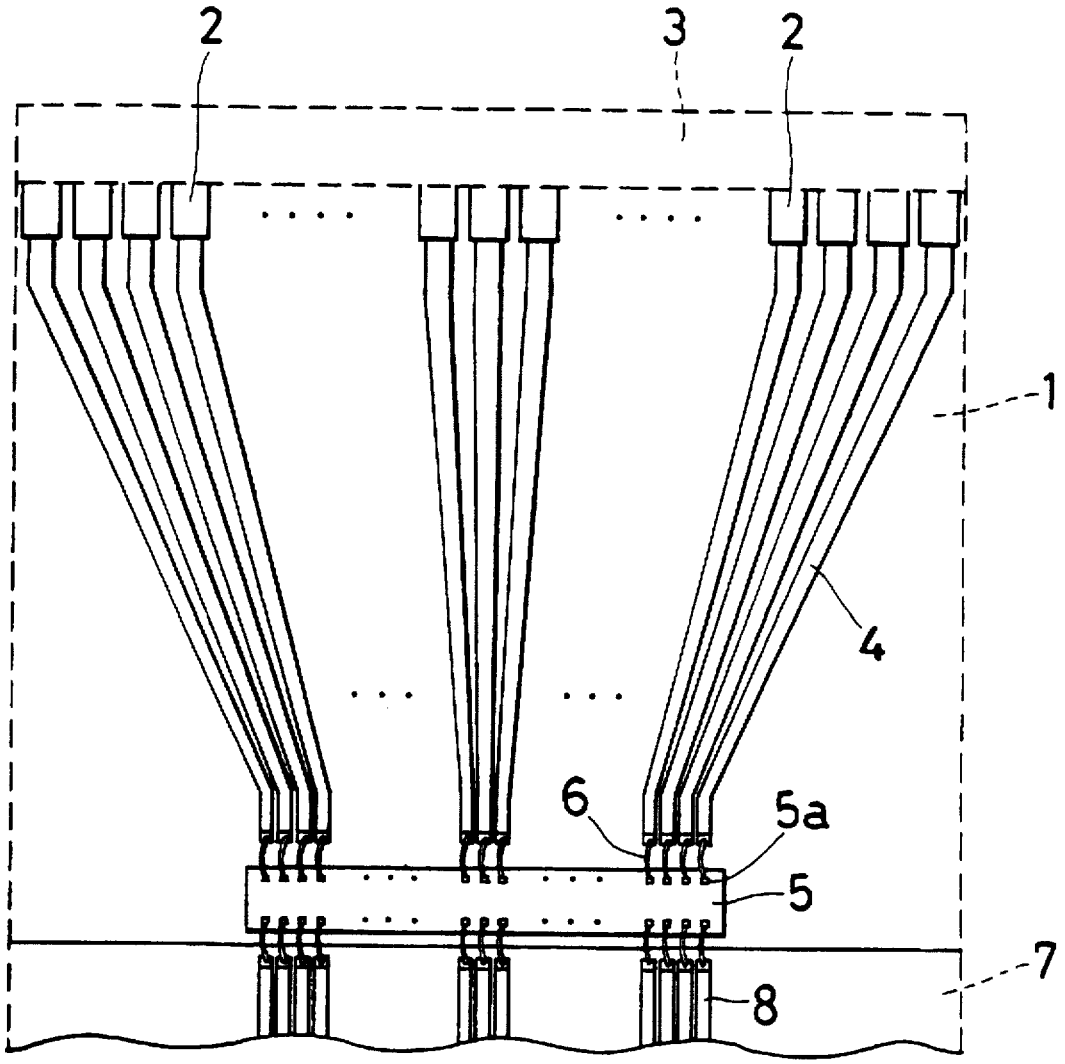
FIG. 7 is a plan view of an additional embodiment of the invention.

FIG. 7 is a plan view illustrative of a still further embodiment of the invention. A noteworthy point of the thermal head shown in FIG. 7 is the establishment of electrical connection between the discrete lead wires 4 and the connecting pads 5a of the driving IC 5 by wire bonding.

The driving IC 5 is fixed onto the electrically insulating substrate 1 by an electrically insulating bonding agent, and a plurality of connecting pads 5a are formed on the top surface of the driving IC 5. The discrete lead wires 4 extend to the vicinity of the driving IC 5, with their connections facing the respective associated connecting pads 5a. The connecting pads 5a and the discrete lead wires 4 are bonded by bonding wires 6. The connecting pads 5a and the discrete lead wires 4 are placed so that the intervals and areas of the connecting pads 5a and discrete lead wires 4 are varied depending on the sine values of the angles between the direction of arrangement of the heating elements 2 and the lead-out directions of the discrete lead wires 4.

On the other hand, a wiring board 7 such as a flexible printed circuit board is bonded to the substrate 1, with the lead wires 8 mounted on the wiring board 7 while facing the respective associated connecting pads 5a. The connecting pads 5a and the mounted lead wires 8 are connected by bonding wires, too.

This wire bonding allows ready establishment of wiring and connection with fine pitches.

Although the driving IC 5 is mounted on the substrate 1 in FIG. 7, the driving IC 5 may be fixed on the wiring substrate 7 and connected with the discrete lead wires 4 on the substrate 1 by wire bonding.

Here, the invention is not limited to the foregoing embodiments, and a variety of variations and modifications are possible without departing from the spirit of the invention. For example, in each of the foregoing embodiments, in the case where protective coats composed of silicon nitride or the like are applied to the top surfaces of the heating elements etc., by well-known sputtering method or the like, the protective coats may prevent abrasion due to sliding contact between the heating elements and the heat-sensitive paper etc., and corrosion due to contact with water etc. in the air. Accordingly, protective coats composed of silicon nitride or the like are preferably provided on the top surfaces of the heating elements etc.

In addition, the substrate composed of ceramic or the like used in the foregoing embodiments has a rough surface, and thus direct mounting of the discrete lead wires on the substrate with small widths and intervals may cause breaking of wires and short circuits. Accordingly, in order to even the rough surface of the substrate, a coat of borosilicate glass, borosilicate lead glass, alkoxide glass or the like may be applied thereon and sintered, and then the discrete lead wires may be mounted on the evened layer which is approximately 5 μm thick. Wiring density of the discrete lead wires may be remarkably increased by evening the substrate in this way.

The above type of even layers are preferably used in regions with high wiring densities of the discrete lead wires. For example, in FIG. 1(A), the discrete lead wires 4 are formed to establish linear connections between the respective heating elements 2 and the respective connecting pads 5a. In this case, an even layer is preferably formed over the entire surface of the substrate.

Since in the embodiment shown in FIG. 7, the discrete lead wires are constructed with end sections near the heating elements 2 and the connecting pads 5a which are formed orthogonal to the direction of arrangement of the heating elements 2 and inclining straight sections with widths and intervals which decrease as the angles of inclination of the lines increase, the above type of even layers are preferably formed for the inclining straight sections. Here, the intervals of the connecting pads 5a and the corresponding discrete lead wires may be varied depending on the angles of inclination of the straight sections so that the intervals increase toward the end sections of the driving IC. The discrete lead wires may each have three or more straight zigzag knee sections.

Figure 8:
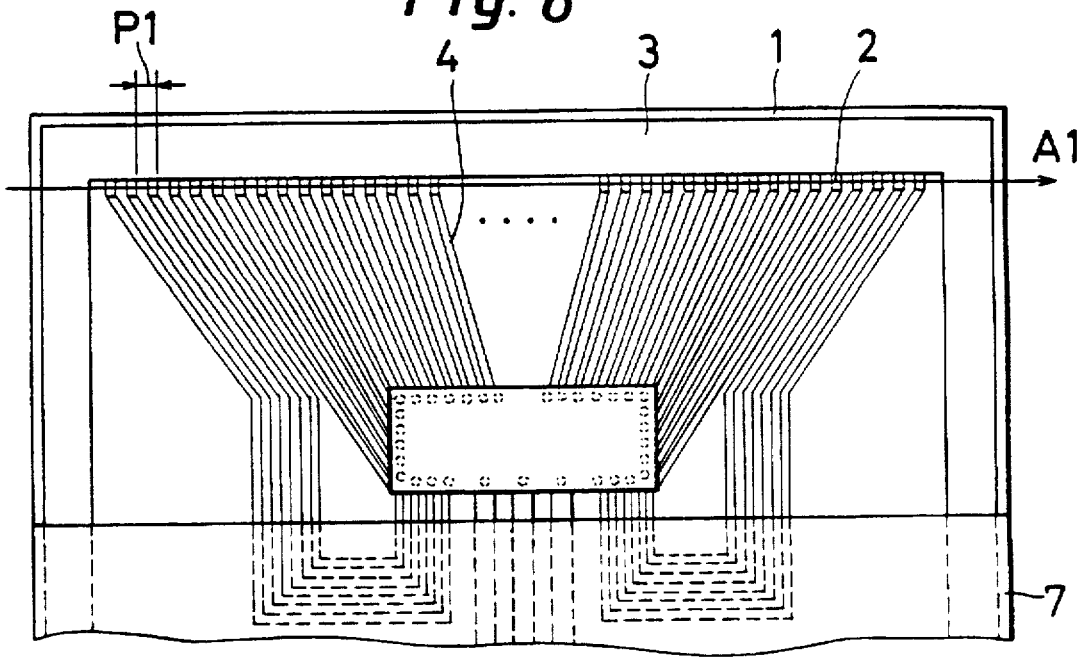
FIG. 8 is a plan view of an additional embodiment of the invention.
Figure 9A:
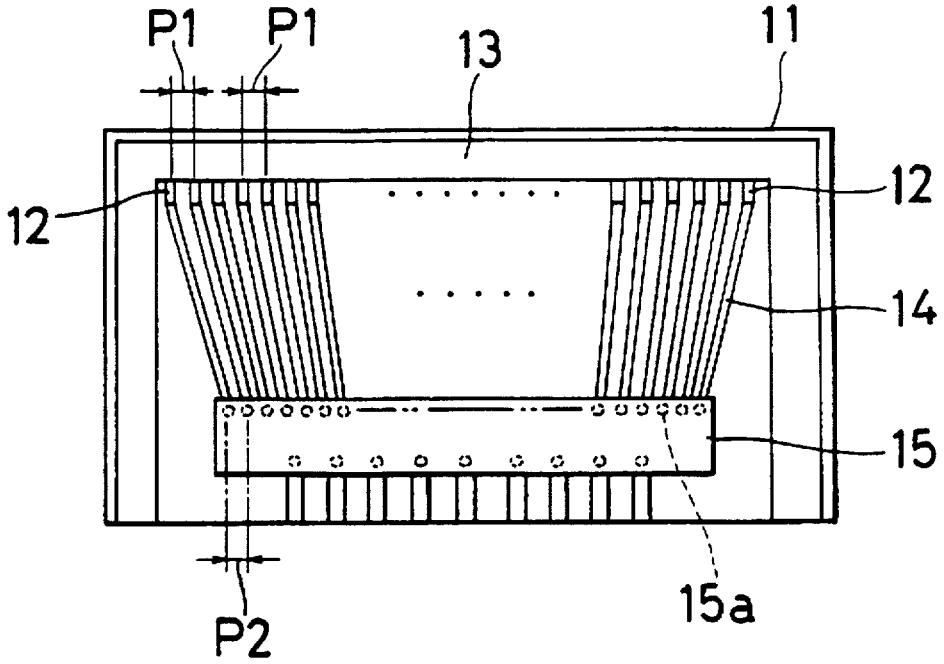
Fig. 9A Prior art
FIG. 9A is a plan view of a prior art thermal head of the prior art.
Figure 9B:
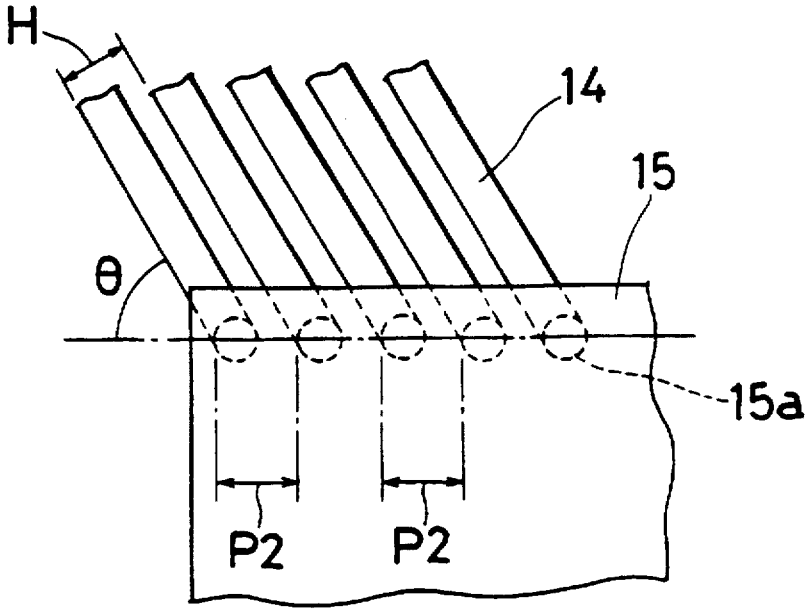
Fig. 9B Prior art
FIG. 9B is a partially enlarged view of FIG. 9A.

Also, in the case where in the driving IC 5 the discrete lead wires are routed to the row of the connecting pads which is positioned far from the heating elements 2, an even layer may be formed under the route area in order to allow increased wiring density in the route area. Separately, in the case where the discrete lead wires are routed even to the back of the driving IC 5 as shown in FIG. 8, the wires may be led via route patterns on their paths which are formed on the wiring board 7. Furthermore, in the case where a plurality of driving ICs are placed, even layers may be formed between the respective driving ICs to allow increased routed wiring density between the IC sets.

Alternatively, the discrete lead wires may be divided, and the resulting pieces of inclining straight sections may be connected by wire bonding or TAB (Tape Automated Bonding).

While the present invention has been explained above with reference to the preferred embodiments, it is to be understood that a variety of alternatives, variations and modifications will be apparent to those skilled in the art, and thus the invention is not limited to the designs and constructions described above, and is to be determined not only by the detailed embodiments, but also by the appended claims and their legal equivalences.

What is claimed is:

1. A thermal head comprising:

an electrically insulating substrate having a surface, a plurality of heating elements arranged at substantially regular intervals on the surface of the electrically insulating substrate, the plurality of heating elements defining a direction, each heating element having a first end and a second end, a common electrode connected to the first end of each heating element, a plurality of lead wires, each one of the plurality of lead wires being connected to a second end of a corresponding one of the plurality of heating elements, each lead wire having at least a length section which extends at a lead wire angle relative to the direction of the heating elements, each lead wire angle having a corresponding sine value, the plurality of lead wires including a first lead wire and a second lead wire, the lead wire angle of the length section of the first lead wire having a first sine value, and the lead wire angle of the length section of the second lead wire having a second sine value different from the first sine value and a driving integrated circuit including a plurality of connecting pads arranged substantially parallel to the direction of the heating elements, wherein adjacent connecting pads define an interval therebetween, the interval between adjacent connecting pads being smaller than the interval at which the heating elements are arranged, each of the connecting pads being connected to a corresponding one of the lead wires, the plurality of connecting pads including a first connecting pad connected to the first lead wire and a second connecting pad connected to the second lead wire, and wherein the interval between the first connecting pad and a connecting pad adjacent the first connecting pad is determined by the first sine value, and the interval between the second connecting pad and a connecting pad adjacent the second connecting pad is determined by the second sine value.

2. The thermal head of claim 1, wherein the driving integrated circuit defines a central section and at least two end sections, a relatively greater number of connecting pads are present in the two end sections than in the central section, and the intervals between adjacent connecting pads are relatively shorter in the central section than in the end sections.

3. The thermal head of claim 1, wherein the driving integrated circuit defines a central section and at least two end sections, the connecting pads in the end sections have a greater area than the connecting pads in the central section, and the intervals between adjacent connecting pads are relatively shorter in the central section than in the end sections.

4. A thermal head comprising:

an electrically insulating substrate having a surface, a plurality of heating elements arranged at regular intervals on the surface of the electrically insulating substrate, the plurality of heating elements defining a direction, each heating element having a first end and a second end, a common electrode connected to the first end of each heating element, a plurality of lead wires, each one of the plurality of lead wires being connected to a second end of a corresponding one of the plurality of heating elements, each lead wire having at least a length section which extends at a lead wire angle relative to the direction of the heating elements, each lead wire angle having a corresponding sine value, the plurality of lead wires including a first lead wire and a second lead wire, the lead wire angle of the length section of the first lead wire having a first sine value, and the lead wire angle of the length section of the second lead wire having a second sine value different from the first sine value and a driving integrated circuit including a plurality of connecting pads arranged substantially parallel to the direction of the heating elements, wherein adjacent connecting pads define an interval therebetween, the interval between adjacent connecting pads being smaller than the regular interval between the heating elements, each of the connecting pads being connected to a corresponding one of the lead wires, the plurality of connecting pads including a first connecting pad connected to the first lead wire and a second connecting pad connected to the second lead wire, and a plurality of connection electrodes arranged on the substrate, each of the connection electrodes being arranged for connection to an associated one of the connecting pads, wherein adjacent connection electrodes define an interval therebetween, the plurality of connection electrodes include a first connection electrode arranged for connection to the first connecting pad and a second connection electrode arranged for connection to the second connecting pad, and wherein the interval between the first connection electrode and a connection electrode adjacent the first connection electrode is determined by the first sine value, and the interval between the second connection electrode and a connection electrode adjacent the second connection electrode is determined by the second sine value.

5. A thermal head comprising:

an electrically insulating substrate having a surface, a plurality of heating elements arranged at substantially regular intervals on the surface of the electrically insulating substrate, the plurality of heating elements defining a direction, each heating element having a first end and a second end, a common electrode connected to the first end of each heating element, a plurality of lead wires, each one of the plurality of lead wires being connected to a second end of a corresponding one of the plurality of heating elements, each lead wire defining a lead wire arc having an associated lead wire arc curvature, the plurality of lead wires including a first lead wire and a second lead wire, a driving integrated circuit including a plurality of connecting pads arranged substantially parallel to the direction of the heating elements, wherein adjacent connecting pads define an interval therebetween, the interval between adjacent connecting pads being smaller than the interval at which the heating elements are arranged, each of the connecting pads being connected to a corresponding one of the lead wires, the plurality of connecting pads including a first connecting pad connected to the first lead wire and a second connecting pad connected to the second lead wire, and wherein the interval between the first connecting pad and a connecting pad adjacent the first connecting pad is determined by the curvature of the arc of the first lead wire, and the interval between the second connecting pad and a connecting pad adjacent the second connecting pad is determined by the curvature of the arc of the second lead wire.

6. The thermal head of claim 5, wherein the driving integrated circuit defines a central section and at least two end sections, a relatively greater number of connecting pads are present in the two end sections than in the central section, and the intervals between adjacent connecting pads are relatively shorter in the central section than in the end sections.

7. The thermal head of claim 5, wherein the driving integrated circuit defines a central section and at least two end sections, the connecting pads in the end sections have a greater area than the connecting pads in the central section, and the intervals between adjacent connecting pads are relatively shorter in the central section than in the end sections.

8. A thermal head comprising:

an electrically insulating substrate having a surface, a plurality of heating elements arranged at substantially regular intervals on the surface of the electrically insulating substrate, the plurality of heating elements defining a direction, each heating element having a first end and a second end, a common electrode connected to the first end of each heating element, a plurality of lead wires, each one of the plurality of lead wires being connected to a second end of a corresponding one of the plurality of heating elements, each lead wire defining a lead wire arc having an associated lead wire arc curvature, the plurality of lead wires including a first lead wire and a second lead wire, a driving integrated circuit including a plurality of connecting pads arranged substantially parallel to the direction of the heating elements, wherein adjacent connecting pads define an interval therebetween, the interval between adjacent connecting pads being smaller than the interval at which the heating elements are arranged, each of the connecting pads being connected to a corresponding one of the lead wires, the plurality of connecting pads including a first connecting pad connected to the first lead wire and a second connecting pad connected to the second lead wire, and a plurality of connection electrodes arranged on the substrate, each of the connection electrodes being arranged for connection to an associated one of the connecting pads, wherein adjacent connection electrodes define an interval therebetween, the plurality of connection electrodes include a first connection electrode arranged for connection to the first connecting pad and a second connection electrode arranged for connection to the second connecting pad, and wherein the interval between the first connection electrode and a connection electrode adjacent the first connection electrode is determined by the curvature of the arc of the first lead wire, and the interval between the second connection electrode and a connection electrode adjacent the second connection electrode is determined b the curvature of the arc of the second lead wire.

* * * * *